US007823554B2

(12) United States Patent
Kleiber

(10) Patent No.: US 7,823,554 B2
(45) Date of Patent: Nov. 2, 2010

(54) CAMSHAFT ADJUSTER WITH A LOCKING SYSTEM

(75) Inventor: Thomas Kleiber, Herzogenaurach (DE)

(73) Assignee: Schaeffler Technologies GmbH & Co. KG, Herzogenaurach (DE)

( * ) Notice: Subject to any disclaimer, the term of this patent is extended or adjusted under 35 U.S.C. 154(b) by 349 days.

(21) Appl. No.: 12/091,770

(22) PCT Filed: Oct. 11, 2006

(86) PCT No.: PCT/EP2006/067284

§ 371 (c)(1),
(2), (4) Date: May 28, 2008

(87) PCT Pub. No.: WO2007/048706

PCT Pub. Date: May 3, 2007

(65) Prior Publication Data

US 2008/0289594 A1 Nov. 27, 2008

(30) Foreign Application Priority Data

Oct. 28, 2005 (DE) ..... 10 2005 051 692

(51) Int. Cl.
*F01L 1/34* (2006.01)

(52) U.S. Cl. ..... 123/90.17; 123/90.15; 123/90.31

(58) Field of Classification Search ..... 123/90.15, 123/90.17, 90.31
See application file for complete search history.

(56) References Cited

U.S. PATENT DOCUMENTS

2002/0011226 A1 1/2002 Scheidt et al.
2003/0196623 A1* 10/2003 Lewis ..... 123/90.17

FOREIGN PATENT DOCUMENTS

| | | |
|---|---|---|
| DE | 19623818 | 12/1996 |
| DE | 10031974 | 1/2002 |
| EP | 0807747 | 11/1997 |
| EP | 1008729 | 6/2000 |
| EP | 1136656 | 9/2001 |
| JP | 11182214 | 7/1999 |
| JP | 2005207431 | 8/2005 |

* cited by examiner

*Primary Examiner*—Zelalem Eshete
(74) *Attorney, Agent, or Firm*—Volpe and Koenig, P.C.

(57) ABSTRACT

A device for adjusting the angle of rotation between two rotating shafts, in particular a drive shaft of a reciprocating-piston internal combustion engine and a camshaft for actuating gas-exchange valves is provided, having a rotation element that is connected in a rotationally fixed manner to the drive shaft, a rotor that is connected in a rotationally fixed manner to the camshaft, and an angle of rotation adjustment system with a locking device which has at least one locking bolt, which is mounted movably in one of the components, and at least one corresponding opening in the other component. The locking bolt can be displaced into and out of the opening by a spring and/or hydraulic force.

10 Claims, 5 Drawing Sheets

CAMSHAFT ADJUSTER WITH A LOCKING SYSTEM

BACKGROUND

A device for adjusting the angle of rotation between two rotating shafts, in particular, between a drive shaft of a reciprocating-piston, internal combustion engine and a camshaft for actuating gas-exchange valves, is provided having a rotation element that is locked in rotation with the drive shaft, a rotor that is locked in rotation with the camshaft, an angle-of-rotation adjustment system and a locking device, which has at least one locking bolt mounted movably in one of the components and at least one corresponding opening in the other component, wherein the locking bolt can be displaced into and out of the opening by a spring and/or hydraulic force.

Such a class-forming device for adjusting the angle of rotation is known from DE 196 23 818 A1. In this device for adjusting the angle of rotation, the rotor has vanes and the rotation element has corresponding recesses, so that the angle of rotation can be adjusted in one direction by pressurized hydraulic fluid provided between the vanes and the rotation element on one side, while pressure applied to the opposite side causes an adjustment of the angle of rotation in the other rotational direction.

To be able to fix the rotor relative to the rotation element, for example, in the end position, a locking device is provided with a locking bolt in one component and an opening in the other component, wherein the force of a spring presses the locking bolt into the opening, while hydraulic fluid displaces the locking bolt out of the opening. This allocation of spring force and hydraulic force to the locking bolt is indeed advantageous in the proposed device, but not absolutely necessary, so that, if necessary, hydraulic force can also displace the locking bolt into the opening, while the force of a spring draws it back.

In the class-forming construction, both the region of the locking bolt interacting with the opening and also the opening have a mutually fitting, conical construction.

With this arrangement there is the problem that the locking bolt must be aligned exactly relative to the opening, so that the locking bolt fits into the opening and has a corresponding support there. If this is not the case, then there is risk of edge forces between the opening and locking bolt. This edge force also occurs for angle deviations between the axes of the opening and the locking bolt. Furthermore, there is the problem that it is difficult to detach the locking bolt from the opening, if a small cone angle is selected and there is a good fit. If a large cone angle is selected, then the locking bolt can be pushed out of the opening by rotating force. In addition, there is the problem, due to the reasons mentioned above and due to tolerance reasons, that it is practically impossible to set a clearance that is sufficiently small and lies advantageously below 0.2 degrees, so that an undesired adjustment error is generated and oscillations, especially rotational oscillations, can occur.

SUMMARY

Therefore, the object of the invention is to construct or to improve a device for adjusting the angle of rotation in such a way that the previously described problems are overcome and a quasi-zero locking play can be achieved.

The object of the invention is met in that the contact region of the locking bolt in active connection with the opening has an outwardly curved contour. The contact region has, in particular, a spherical barrel contour.

Through this construction, it is achieved that the angular position of the locking bolt has only minor significance, because the support of the locking bolt is realized with an essentially annular form by the curved contour or spherical barrel contour. This is initially independent of the form or contour of the opening, if it is guaranteed that the dimensions between the opening cross section and the curved or spherical barrel contour are selected so that the locking bolt reaches a sufficient depth in the opening. In this way, the production tolerance and dimensional stability can also be increased.

In another construction of the invention, it is proposed that the contact region of the locking bolt, which comes into active connection with the opening, has the shape of a spherical segment between two parallel circles. Here, a shape is provided, in which the center of the sphere, from which the segment originates, is located in the direction of the support of the locking bolt, so that the radius is smaller at the end of the bolt in the direction toward the opening than the radius at the opposite end of the contact region.

The contour of the locking bolt, however, can also be constructed as a rotated paraboloid section.

Here there is the possibility of selecting the section so that it has a flatter or steeper profile according to the construction of the parabola.

Furthermore, it is important that a transition radius, which is relatively large and which is advantageously greater than 0.5 mm, is provided at the free end of the locking bolt. In this way, it is achieved that only small edge stresses and edge pressures occur when the locking bolt is not inserted completely into the opening.

In another construction of the invention, for a device, in which the opening is arranged in a cover of the rotation element, it is proposed that the opening has truncated cone-like contour in its depth extending away from the locking bolt and that the run-in phase similarly has a large transition radius, which is advantageously greater than 0.5 mm.

For the class-forming device, an opening in the cover with a conical contour is indeed known, but this is in active connection with a locking bolt, which similarly has a conical end. In the present case, the conical or tapered contours of the opening are in active connection with the curved or spherical barrel-shaped contour or with the spherical segment or with the rotated paraboloid section, so that very different relationships and other driving mechanisms are produced.

The contour of the opening in the cover, however, can also have a construction that is curved inward or can have the contour of a rotated hyperboloid section.

In this way, both the relevant locking bolt section and also the contours of the opening have contours inclined toward each other, so that a large production tolerance for the locking bolt and the borehole or also the support of the locking bolt is possible, without producing twisting, increased surface pressures, or increased rotational play. If such a locking bolt is pressed into the opening, then it is easy to see that quasi-zero locking play is produced.

Both the opening or the cover and also the locking bolt can be produced economically by a forming process, by which sufficient dimensional accuracy is achieved.

To achieve the highest possible strength both in the opening and also in the locking bolt, it is proposed that these are strengthened by self-quenching hardening processes, e.g., plasma hardening, laser hardening, and the like.

BRIEF DESCRIPTION OF THE DRAWINGS

For further explanation of the invention, the drawings will be referenced, in which exemplary embodiments of the invention are shown simplified. Shown are.

DETAILED DESCRIPTION OF THE PREFERRED EMBODIMENTS

Figure 1:
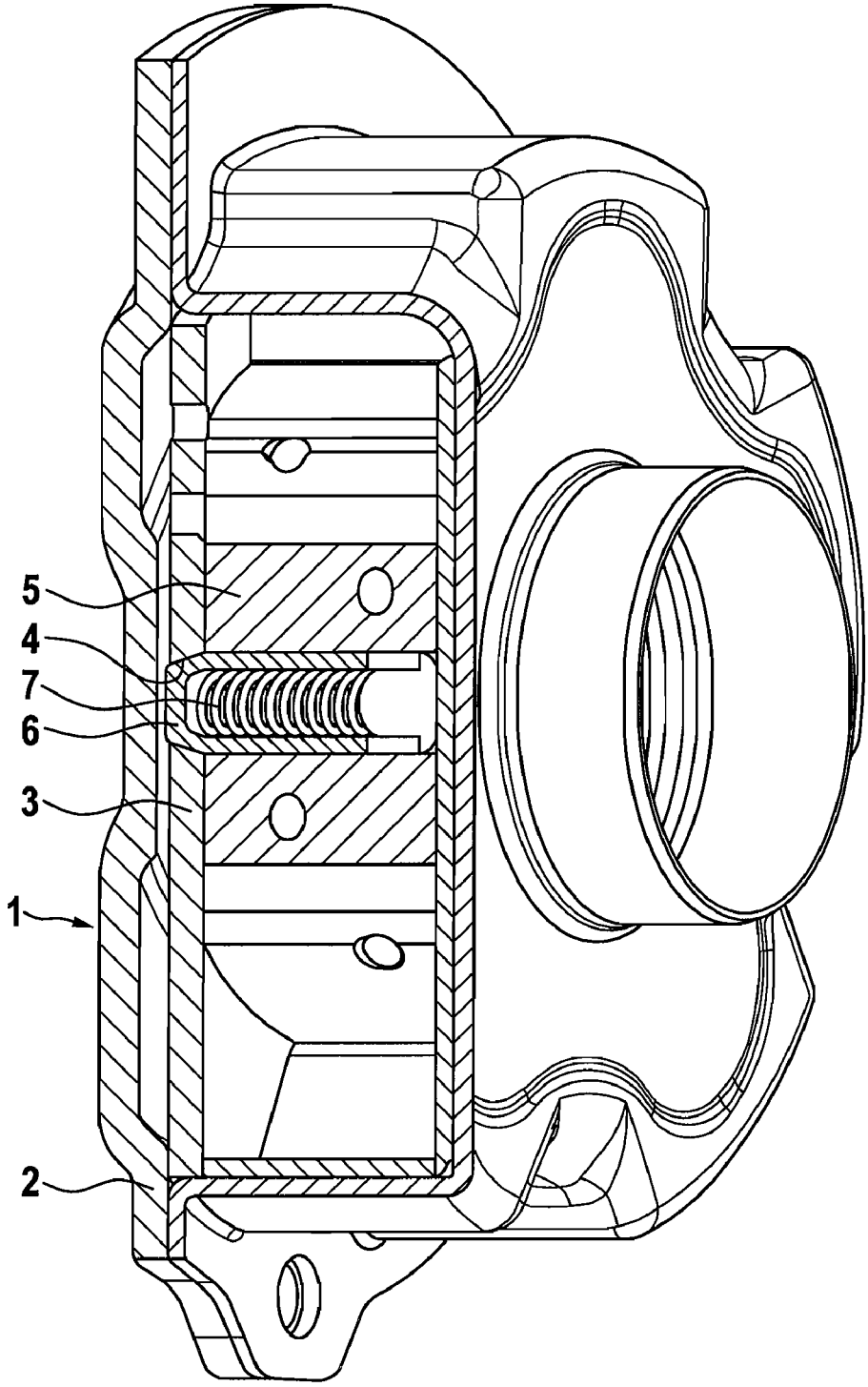
FIG. 1: a perspective view of a device for adjusting the angle of rotation with partial section through the device.
Figure 2:
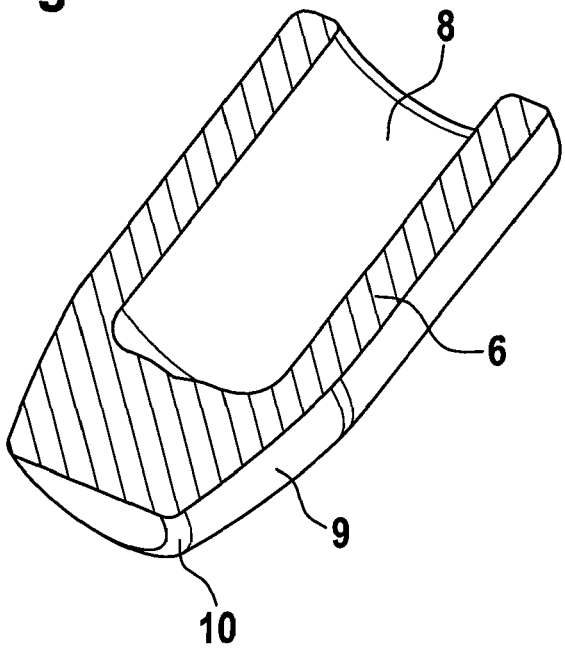
FIG. 2: a perspective view of a locking bolt with section through the same part.
Figure 3:
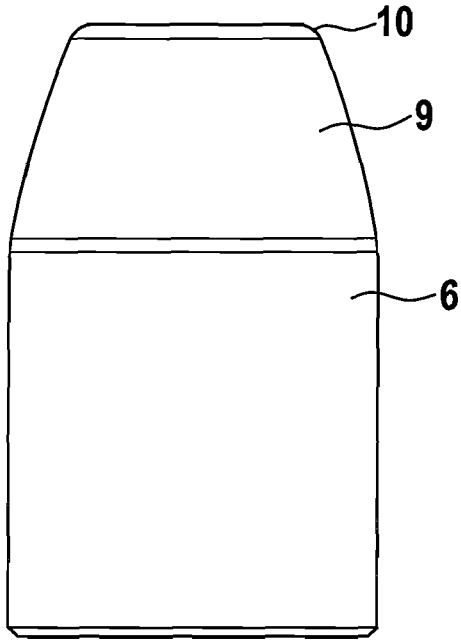
FIG. 3: an outer view of a locking bolt.

In FIGS. 1 to 11, as shown in detail, a device for adjusting the angle of rotation is designated with 1, which has a rotation element 2 with a cover 3, in which an opening 4 is formed. The cover 3 is arranged within the rotation element 2, which has chambers, not shown, in which vanes of a rotor designated with 5 are arranged. The rotor 5 is locked in rotation with a camshaft, not shown, of a reciprocating piston, internal combustion engine, while the rotation element 2 is in active connection with a drive shaft, similarly not shown, of the reciprocating-piston, internal combustion engine via a geared, chain, or toothed belt drive. A locking bolt designated with 6 is mounted in a borehole of the rotor 5, and is biased in the direction toward the opening 4 by a compression spring 7 and can be pulled out of the opening, not shown in detail, by hydraulic pressure. The locking bolt 6 is provided with a hollow space 8, see, in particular FIG. 2, in which the compression spring 7 is partially inserted. The locking bolt 6 has a cylindrical region, in which it is guided and supported in the borehole of the rotor. A radius, and also a contact region 9, with which the locking bolt 6 can come into active connection with the opening 4, is adjacent to the cylindrical region. The contact region 9 has a contour, which is curved outward and which has a spherical barrel-shaped construction. A transition radius, which is designated with 10 and which is selected to be large, is adjacent to the contact region 9.

Figure 4:
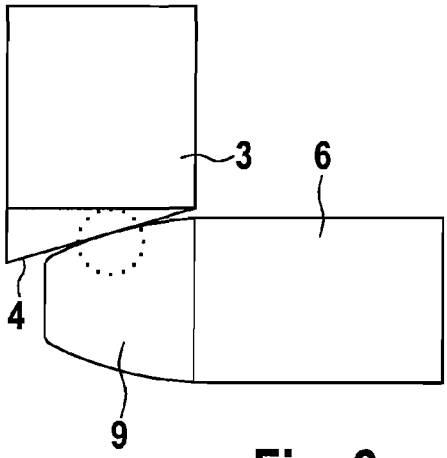
FIGS. 4-8: schematic views of a cover with an opening with a tapered contour and a spherical barrel-shaped end of the locking bolt in different positions.

In the section diagrams of FIGS. 4 to 8, the contour of the opening 4 has a truncated cone-shaped construction. In all of the cases, the locking bolt has a spherical barrel-shaped construction in the contact region 9. FIG. 4 shows the normal position, i.e., the desired position of the locking bolt with its contact region 9 in the opening 4.

Figure 5:
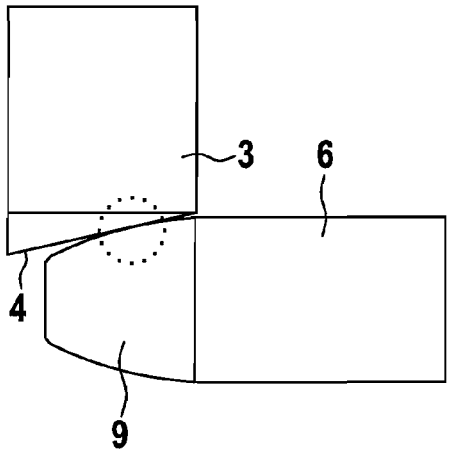

FIG. 5 shows an example, in which the truncated cone-shaped angle is smaller than in the normal position. Nevertheless, a problem-free engagement of the contact region 9 of the locking bolt 6 in the opening 4 is produced, based on the special contour of the contact region 9.

Figure 6:
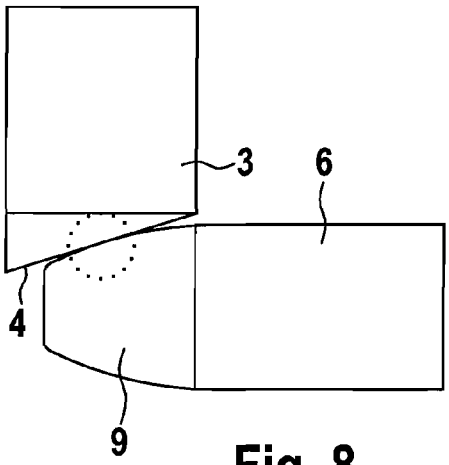

In FIG. 6, the truncated cone-shaped angle is greater than in the normal position, wherein there it is also shown that a problem-free support of the locking bolt 6 in the opening 4 is provided based on the spherical barrel-shaped contour of the contact region 9.

Figure 7:
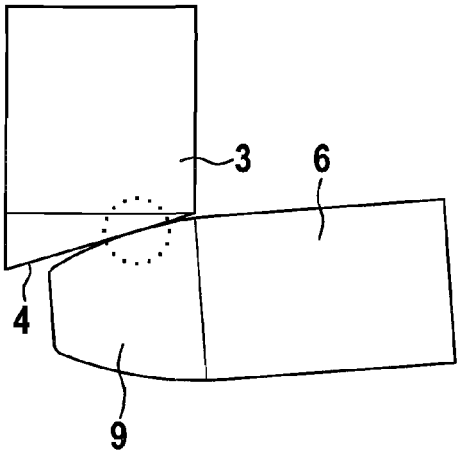
Figure 8:
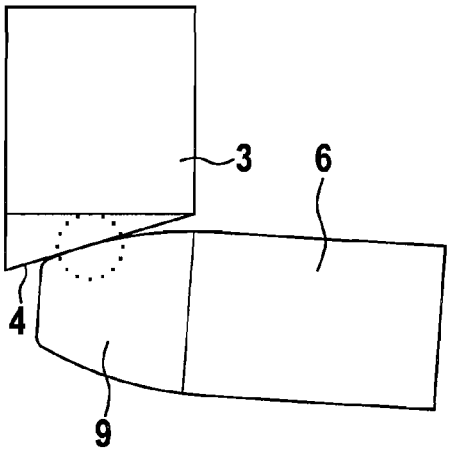

FIGS. 7 and 8, which have a construction corresponding to FIGS. 4 to 6, show that angle errors in the guidance of the locking bolt 6 within certain tolerances can also be absorbed without a problem.

Figure 9:
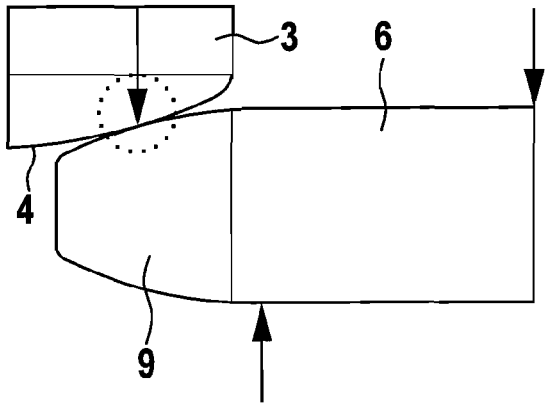
FIGS. 9-11: schematic views of an opening of a cover, which has a curved construction, with spherical barrel-shaped locking bolt.
Figure 10:
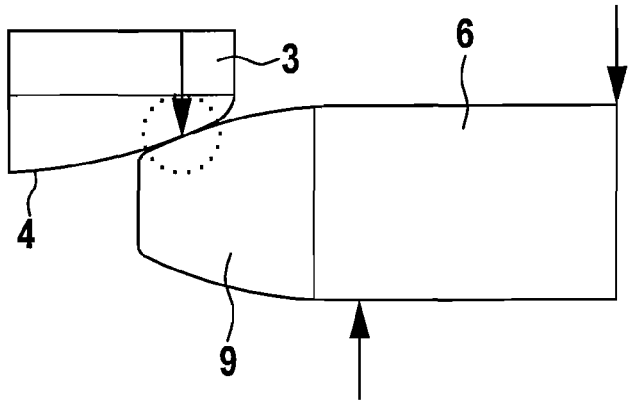
Figure 11:
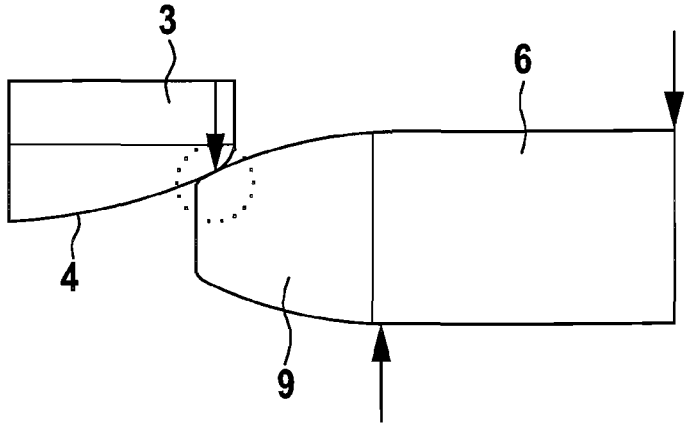

In FIGS. 9 to 11, the spherical barrel-shaped contour of the contact region 9 has a construction that is not changed relative to FIGS. 2 to 8, wherein the contour of the opening 4 is curved inward, and a large transition radius is provided at the edge of the opening 4 facing the locking bolt 6.

It is taken from FIGS. 9 to 11 that large errors can also be absorbed by the locking device according to the invention.

Figure 12:
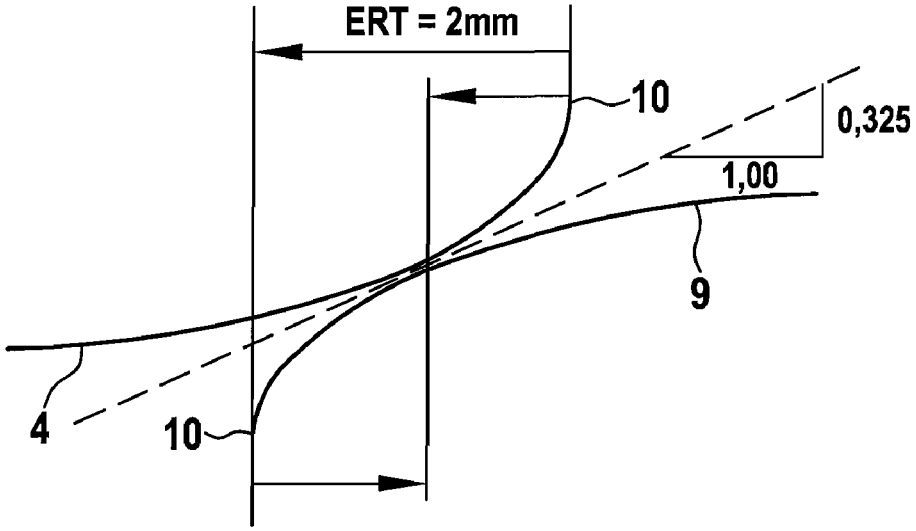
FIGS. 12 and 13: enlarged scale views of the contact region between the locking bolt and the opening.
Figure 13:
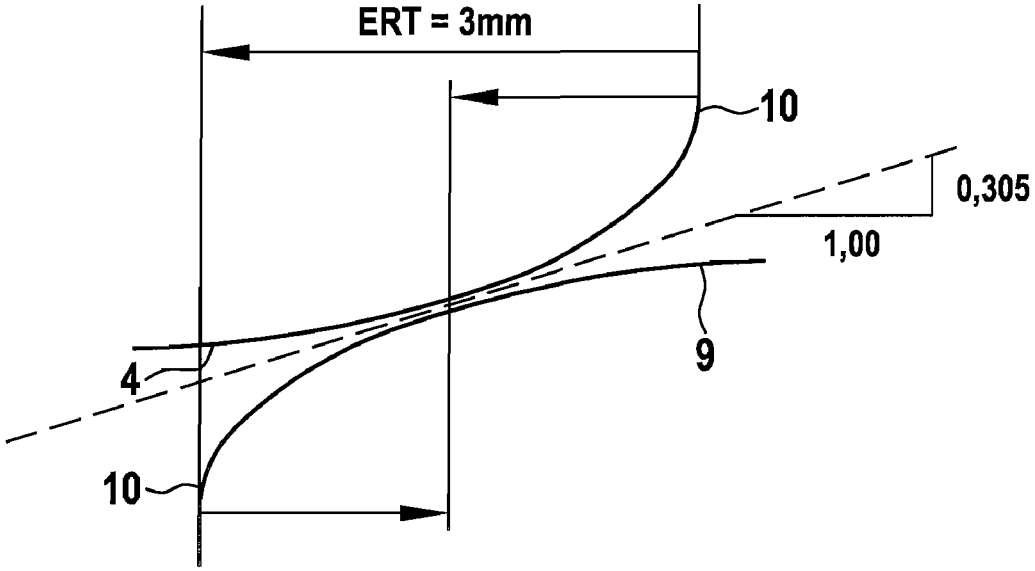

In FIGS. 12 and 13, the contact region 9 of the locking bolt 6 is shown at an enlarged scale, wherein it can be seen that this region has a construction corresponding to a rotated paraboloid section. The corresponding region of the opening 4 corresponds to a rotated hyperboloid section. In FIG. 12, the dimensions are selected so that the locking bolt 6 does not penetrate far into the opening 4, while in FIG. 13, a flat angle is produced in the contact transition between the locking bolt 6 and the opening 4.

LIST OF REFERENCE SYMBOLS

1 Device for adjusting the angle of rotation
2 Rotation element
3 Cover
4 Opening
5 Rotor
6 Locking bolt
7 Compression spring
8 Hollow space
9 Contact region
10 Transition radius

The invention claimed is:

1. Device for adjusting an angle of rotation between first and second rotating shafts, the first shaft being a drive shaft and the second shaft being a camshaft of an internal combustion engine, the device comprising a rotation element, which is locked in rotation with the drive shaft, a rotor, which is locked in rotation with the camshaft, a device for adjusting the angle of rotation, and a locking device, which has at least one locking bolt mounted movably in one of the rotation element or the rotor and at least one corresponding opening in the other of the rotation element or the rotor, wherein the locking bolt can be displaced into and out of the opening by spring force or hydraulic force, and a contact region of the locking bolt coming into active connection with the opening has an outwardly curved contour wherein the contact region of the locking bolt has a spherical barrel-shaped contour.

2. Device for adjusting the angle of rotation according to claim 1, wherein the contact region of the locking bolt has the shape of a spherical segment between two parallel circles.

3. Device for adjusting the angle of rotation according to claim 1, wherein the contour of the locking bolt has a rotated paraboloid section construction.

4. Device for adjusting the angle of rotation according to claim 1, wherein a transition radius, which is greater than 0.5 mm, is provided on a free end of the locking bolt.

5. Device for adjusting the angle of rotation according to claim 1, wherein the opening is arranged in a cover of the rotation element the opening has a truncated cone-shaped contour in depth extending away from the locking bolt and an entry phase of the opening has a transition radius that is greater than 0.5 mm.

6. Device for adjusting the angle of rotation according to claim 5, wherein the contour of the opening is curved inwardly or convexly.

7. Device for adjusting the angle of rotation according to claim 5, wherein the contour of the opening has the shape of a rotated hyperboloid section.

8. Device for adjusting the angle of rotation according to claim 1, wherein the opening and the locking bolt are produced by forming processes.

9. Device for adjusting the angle of rotation according to claim 1, wherein the contour of the opening or the locking bolt are hardened.

10. Device for adjusting the angle of rotation according to claim 9, wherein the contour of the opening or the locking bolt is plasma or laser hardened.

* * * * *